US006389261B1

(12) United States Patent
Fratangelo et al.

(10) Patent No.: US 6,389,261 B1
(45) Date of Patent: May 14, 2002

(54) LOW LOAD FUSER MEMBER AND A FUSING APPARATUS AND A COLOR IMAGE REPRODUCTION MACHINE INCLUDING SAME

(75) Inventors: Louis D. Fratangelo, Fairport; Patrick J. Finn, Webster; Richard G. Labombard, Williamson, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/692,199

(22) Filed: Oct. 19, 2000

(51) Int. Cl.[7] ..... G03G 15/20

(52) U.S. Cl. ..... 399/328; 399/330; 399/333; 219/216; 430/124

(58) Field of Search ..... 219/216; 399/328, 399/329, 330; 430/99, 124

(56) References Cited

U.S. PATENT DOCUMENTS 6,061,545 A * 5/2000 Cerrah ..... 399/330
6,183,929 B1 * 2/2001 Chow et al. ..... 430/124

* cited by examiner

*Primary Examiner*—Arthur T. Grimley
*Assistant Examiner*—Hoang Ngo
(74) *Attorney, Agent, or Firm*—Tallam I. Nguti; Joseph M. Young

(57) ABSTRACT

A low load fuser member for heating and fusing high quality toner images onto an image carrying substrate is provided. The low load fuser member includes a soft, low durometer and thermally non-conductive first elastomeric material member for forming a relatively large fusing nip at a relatively low load; a second and thermally conductive elastomeric material forming an intermediate layer over the first elastomeric material member; and a toner image release layer formed over the intermediate layer for facilitating release of fused toner images.

15 Claims, 2 Drawing Sheets

LOW LOAD FUSER MEMBER AND A FUSING APPARATUS AND A COLOR IMAGE REPRODUCTION MACHINE INCLUDING SAME

BACKGROUND OF THE INVENTION

This invention relates generally to electrostatographic reproduction machines, and more particularly to a low load fuser member, such as a roller, and a fusing apparatus and a color image reproduction machine, such as a copier or a printer, including same.

Reproduction machines such as copiers and printers typically employ the art or process of xerography. The art or process of xerography involves forming electrostatic latent images on a surface by first uniformly charging a photoreceptor. The photoreceptor comprises a charge retentive surface. The charge is image-wise selectively dissipated in accordance with an image pattern of activating radiation corresponding to an original image. The selective dissipation of the charge leaves a latent charge pattern on the imaging surface corresponding to the areas not exposed by radiation.

This charge pattern is then developed, or made visible with a development apparatus or unit containing developer material such as single component, or toner and other components including carrier particles. The toner is generally a colored powder which is charged and adheres to the charge pattern by electrostatic attraction resulting in a toner developed image. The toner developed image is then fixed to the imaging surface or is transferred to a receiving substrate such as plain paper to which it is thereafter fixed by suitable fusing techniques.

Black and white toner images can be formed by the process as described above, and multicolor toner images can be similarly formed by using not just one but several development units containing different colors of toner. Such multicolor toner images can be highlight color images or full color images. One approach for forming such toner images is in a single pass of the photoreceptor during which color separation toner images are formed in registration, one on another, or in what is called an "image-on-image" manner.

The final quality images produced or reproduced by image-on-image reproduction machines, depends in great part on quality fusing using a fuser roller in a fusing apparatus. A fuser roller and a fusing apparatus that are thermally efficient, and that can form a large or long fusing nip with as low a load as possible are desirable. In attempts to achieve large fusing nips under such conditions, conventional composite constructed fuser rollers have been proposed, having multiple layers of a fluoroelastomer, such as a copolymer of vinylidene fluoride and hexafluoropropylene known commercially as VITON A, or such as a terpolymer of vinylidene fluoride, hexafluoropropylene and tetrafluoroethylene, known commercially as VITON B. VITON A and VITON B and other VITON designations, are trademarks of E. I. duPont de Nemours and Company. Such conventional composite constructed fuser rollers also include for example, a conductive silicone base, a conductive flouroelastomer (VITON) interlayer and a thin top toner release layer of relatively insulative flouroelastomer (VITON).

Although some such conventional composite fuser rollers may be thermally efficient, they have been found to deficient in other respects due to the high hardness of the conductive flouroelastomer (VITON) layers which result in image quality defects such as "halo" and differential gloss. Further attempts to resolve such problems with such conventional fuser rollers tend to simply add costs, and normally to result in undesirably higher loads and strain energy.

There is therefore a need for a relatively low cost, thermally efficient and low load fuser roller, and a fusing apparatus including same, for use particularly in a color image reproduction machine to assure final color image quality.

SUMMARY OF THE INVENTION

In accordance with the present invention, there is provided a low load fuser member and fusing apparatus in a color reproduction machine for fusing high quality toner images onto an image carrying substrate. The low load fuser member for heating and fusing high quality toner images onto an image carrying substrate includes a soft, low durometer and thermally non-conductive first elastomeric material member for forming a relatively large fusing nip at a relatively low load; a second and thermally conductive elastomeric material forming an intermediate layer over the first elastomeric material member; and a toner image release layer formed over the intermediate layer for facilitating release of fused toner images.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
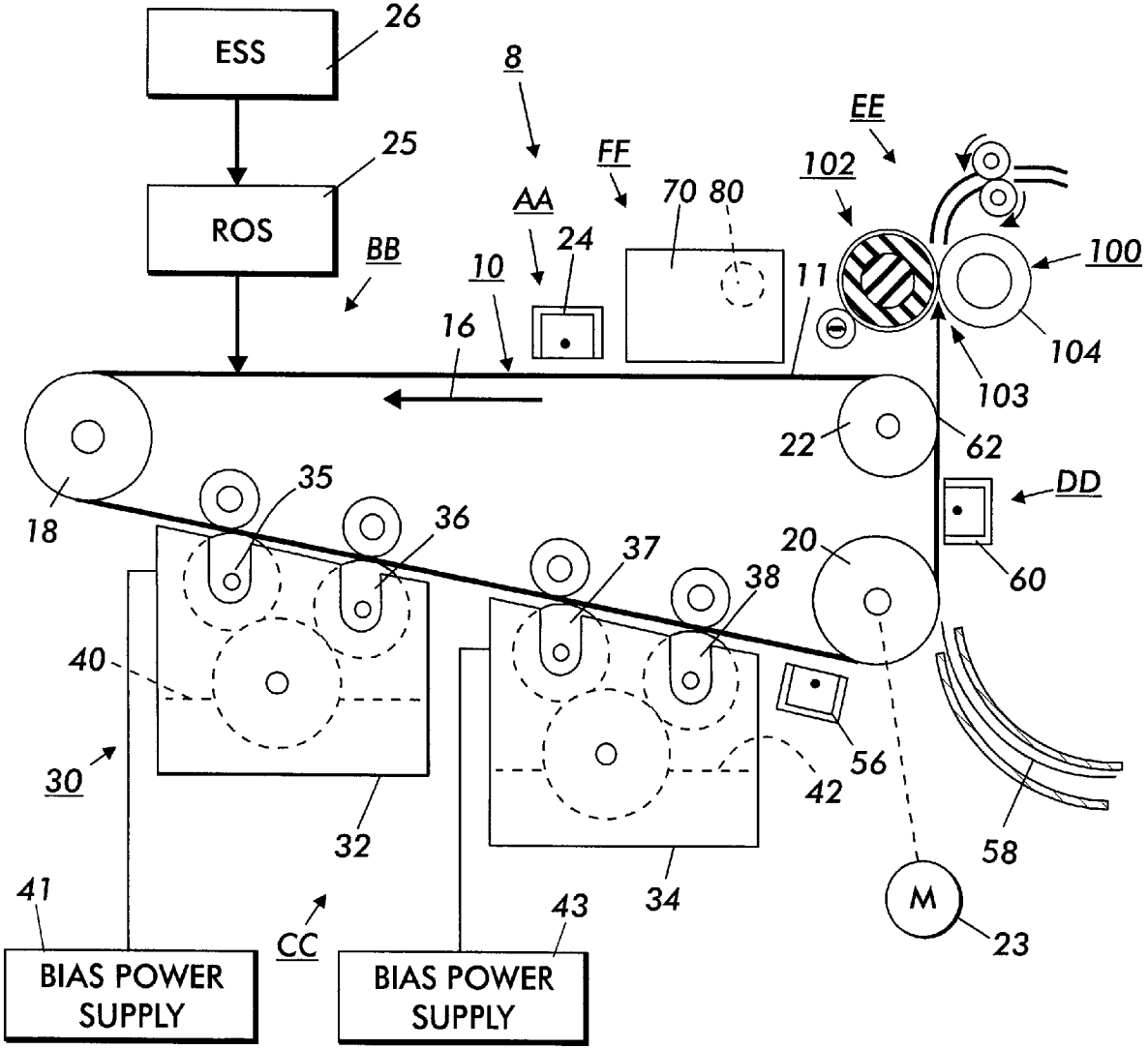
FIG. 1 is a schematic illustration of an electrostatographic reproduction machine incorporating the fusing apparatus and low load fuser roller of the present invention.

Referring now to FIG. 1, there is illustrated an electrostatographic reproduction machine, for example, a highlight color reproduction machine 8 in which the low load fuser roller and fusing apparatus of the present invention (to be described in detail below) may be utilized. It is understood that the low load fuser roller and fusing apparatus of the present invention can be used equally in an image-on-image full color reproduction machine.

In highlight color xerography as taught by Gundlach in U.S. Pat. No. 4,078,929, the xerographic contrast on the charge retentive surface or photoreceptor is divided into three levels, rather than two levels as is the case in conventional xerography. The photoreceptor is charged, typically to a full potential, e.g. 900 volts. It is first exposed image-wise, such that one image corresponding to charged image areas (which are subsequently developed by charged-area development, i.e. CAD) stays at the full potential. The other image is exposed to form a second or highlight image by discharging the photoreceptor to a residual potential, (typically about 100 volts). The second exposure provides discharged area images (that are subsequently developed by discharged-area development, i.e. DAD). To form the background areas, the photoreceptor exposure in the background areas is such as to result in a potential that is halfway, (typically 500 volts), between the full potential of CAD areas and the residual potential of DAD areas.

As illustrated, the highlight color reproduction machine 8 comprises a charge retentive member in the form of a photoconductive belt 10 consisting of a photoconductive surface 11 and an electrically conductive substrate 13. The photoconductive belt 10 is mounted for movement past a series of processing stations including a charging station AA, an exposure station BB, a developer station CC, a transfer station DD, and a cleaning station FF.

As shown, belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. A motor 23 rotates roller 18 to advance belt 10 in the direction of arrow 16. Roller 18 is coupled to motor 23 by suitable means such as a belt drive.

By further reference to FIG. 1, initially as successive portions of photoreceptor surface of belt 10 pass through charging station AA, a corona discharge device such as a scorotron, corotron or dicorotron indicated generally by the reference numeral 24, charges portions of the charge retentive surface of the belt 10 passing under the device 24 to a selectively high and uniform positive or negative full potential. Any suitable control, well known in the art, may be employed for controlling the corona discharge device 24.

Next, the charged portions of the charge retentive surface of the photoreceptor of belt 10 are advanced through exposure station BB. At exposure station BB, each uniformly charged portion is image-wise exposed, for example, by a laser based input and/or output scanning device 25, that is controlled by an electronic subsystem (ESS) controller 26, and that causes the charge retentive surface to be discharged in accordance with the image data output from the scanning device 25. Preferably the scanning device 25 is a three level laser Raster Output Scanner (ROS) for differentially discharging the fully charged surface so as to result in fully charged CAD image areas, discharged DAD image areas and discharged background areas.

The three level laser Raster Output Scanner (ROS) device 25 does so under the control of the electronic subsystem (ESS) controller 26 which also provides control for other subassemblies of the machine 8. When the photoreceptor which is charged to a desired initial full voltage or potential is exposed at the exposure station BB, it is discharged to a voltage or potential that is near zero or ground potential in the highlight (i.e. color other than black) color parts of the image (DAD image areas). The photoreceptor is also halfway discharged image-wise in the background (white) image areas, leaving other areas at the full potential, (CAD image areas). The result is a tri-level electrostatic latent image comprised of two types of image areas, i.e. CAD image areas and DAD image areas, and of background areas.

At development station CC, a development system, indicated generally by the reference numeral 30 advances developer materials into contact with the electrostatic latent images, and develops the image. The development system 30, as shown, comprises first and second developer apparatuses 32 and 34. The developer apparatus 32 comprises a housing containing a pair of magnetic brush rollers 35 and 36. The rollers advance developer material 40 into contact with the photoreceptor for developing the discharged-area images. The developer material 40, by way of example, contains negatively charged color toner. Electrical biasing is accomplished via power supply 41 electrically connected to developer apparatus 32. A DC bias is applied to the rollers 35 and 36 via the power supply 41.

The developer apparatus 34 comprises a housing 32 containing a pair of magnetic brush rolls 37 and 38. The rollers advance developer material 42 into contact with the photoreceptor for developing the charged-area images. The developer material 42 by way of example contains positively charged black toner for developing the charged-area images. Appropriate electrical biasing is accomplished via power supply 43 electrically connected to developer apparatus 34. A DC bias is applied to the rollers 37 and 38 via the bias power supply 43.

Because the composite image developed on the photoreceptor consists of both positive and negative toner, a pre-transfer corona discharge member 56 is provided to condition the toner for effective transfer to a substrate using corona discharge of a desired polarity, either negative or positive.

Sheets of substrate or support material 58 are advanced to transfer station DD from a supply tray, not shown. Sheets are fed from the tray by a sheet feeder, also not shown, and advanced to transfer station DD through a corona charging device 60. After transfer, the sheet continues to move in the direction of arrow 62 towards fusing station EE.

Still referring to FIG. 1, after the toner image has been transferred as above onto the substrate 58, residual toner on the surface 11 of the image bearing member 10 is removed or cleaned off at a cleaning station FF, thus preparing the surface 11 for forming another color image thereon. At Cleaning station FF, a cleaning apparatus 70 removes such residual toner and means such as a vacuum device 80 exhausts the residual toner from cleaning apparatus 70.

Figure 2:
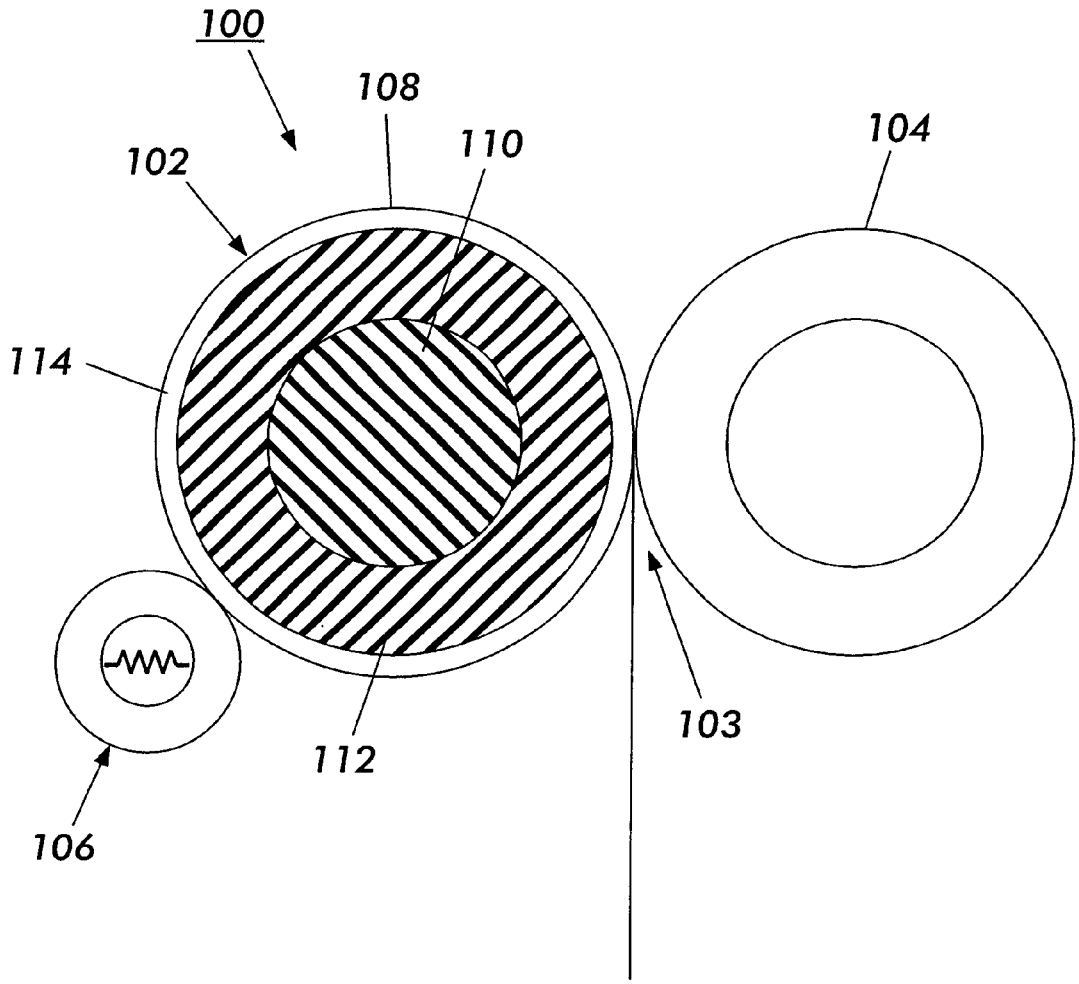
FIG. 2 is a detailed illustration of the fusing apparatus and low load fuser roller of the present invention.

Referring now to FIGS. 1–2, fusing station EE includes the fusing apparatus 100 and low load fuser member such as roller 102 of the present invention. It should be noted that although the low load member 102 is illustrated as a roller, it can equally be a belt fuser member comprising the disclosed layers as below. Broadly, the low load fuser member such as roller 102 is comprised of a multilayer construction consisting of relatively thinner elastomeric materials, so as to enable achievement of a relative large nip 103, against a pressure roller 104, at a relatively low load.

As shown in more detail in FIG. 2, the multiple layers include a first unfilled low durometer silicone rubber base layer 110 (first layer) that is a very soft and thick silicone rubber. The first layer 110 as such is then covered with a second thin thermally conductive silicone layer 112 (second layer) which preferably has a relatively low modulus for a given thermal conductivity. As further shown, the low load fuser member such as roller 102 also includes a relatively very thin toner release top layer 114 that preferably is made of flouroelastomer (VITON) (where VITON is a trade name of the Du Pont Company).

The second layer is designed to advantageously accept thermal energy from an external heat source 106, such as an external heat roller as shown. This second layer is also designed to facilitate the quick and easy giving up of heat and temperature to the toner image being fused and the substrate carrying it. The first layer 110, (the low durometer rubber base layer) advantageously allows for and enables the formation of large fusing nips at relatively low fusing apparatus loads.

The low load fuser member such as roller 102 as such, has been proven not to contribute to copy quality defects such as halo, and hence to result in relatively high quality fused color images. The advantages of the low load fuser member such as the roller 102, and the fusing apparatus 100 including it, are believed to include a relatively lower cost of construction, larger fusing nips and hence longer fusing nip dwell times, all achievable at reasonable process conditions such low strain energy, which help alleviate problems such as differential gloss.

Referring in particular to FIG. 2, the fusing station EE specifically includes the fusing apparatus 100 which as illustrated includes the pressure roller 104, the external heating device 106 such as a heating roller as shown, for heating a fusing surface 108 of a fuser member. The fusing apparatus 100 also includes the low load, fuser member 102, shown in the form of a roller, that is mounted in heat receiving relationship with the external heating device 106, as well as in engagement with the pressure roller 104 to form the fusing nip 103. As illustrated, the low load fuser member such as a roller 102 includes a soft, low durometer first elastomeric material member (or first layer) 110 for enabling the forming of a relatively large fusing nip at a relatively low load, and an intermediate (or second) layer 112 of a second elastomeric material formed over the first elastomeric material member and which defines a fusing layer. The low load fuser member such as a roller 102 further a toner image release layer 114 that is formed over the intermediate layer 112 of the second elastomeric material for facilitating the release of fused toner images from the fusing member such as the roller 102 of the present invention.

The first elastomeric material member 110 comprises an unfilled low durometer, and thermally non-conductive first silicone rubber. The second elastomeric material of the intermediate layer 112 instead comprises a thermally conductive second silicone rubber. The first elastomeric material 110 is relatively softer than the thermally conductive, second elastomeric material of the intermediate layer 112. For thermal efficiency and nip formation requirements, the intermediate layer 112 preferably has a thickness within a range of 0.3 to 7.0 mm. As pointed out above, the toner release layer 114 is comprised of a relatively very thin layer of flouroelastomer (VITON).

As can be seen, there has been provided a low load fuser member and fusing apparatus in a color reproduction machine for fusing high quality toner images onto an image carrying substrate. The low load fuser member for heating and fusing high quality toner images onto an image carrying substrate includes a soft, low durometer and thermally non-conductive first elastomeric material member for forming a relatively large fusing nip at a relatively low load; a second and thermally conductive elastomeric material forming an intermediate layer over the first elastomeric material member; and a toner image release layer formed over the intermediate layer for facilitating release of fused toner images.

While the embodiments of the present invention disclosed herein are preferred, it will be appreciated from this teaching that various alternative, modifications, variations or improvements therein may be made by those skilled in the art, which are intended to be encompassed by the following claims:

What is claimed:

1. A low load elastomeric fuser roller for heating and fusing toner images, the low load elastomeric fuser roller comprising:

(a) a first elastomeric material member forming a generally cylindrical roller core for forming a relatively large fusing nip at a relatively low load;

(b) a second elastomeric material forming a fusing layer having a thickness of from about 0.3 to about 7.0 mm over said cylindrical roller core; and (c) a toner image release layer formed over said fusing layer for facilitating release of fused toner images.

2. The low load elastomeric fuser roller of claim 1, wherein said first elastomeric material comprises a thermally non-conductive first silicone rubber.

3. The low load elastomeric fuser roller of claim 2, wherein said thermally non-conductive first silicone rubber comprises an unfilled low durometer silicone rubber.

4. The low load elastomeric fuser roller of claim 3, wherein said unfilled low durometer first silicone rubber is relatively softer than said thermally conductive second silicone rubber.

5. The low load elastomeric fuser roller of claim 1, wherein said second elastomeric material comprises a thermally conductive second silicone rubber.

6. The low load elastomeric fuser roller of claim 1, wherein said toner release layer comprises a layer of a flouroelastomer.

7. A low load fusing apparatus comprising:

(a) a pressure roller;

(b) an external heating device; and (c) a low load fuser roller mounted in heat receiving relationship with said external heating device and in fusing nip engagement with said pressure roller, said low load fuser roller including:

(i) a first elastomeric material forming a generally cylindrical core for forming a relatively large fusing nip;

(ii) a second elastomeric layer forming a fusing layer having a thickness of from about 0.3 to about 7.0 mm over said cylindrical core; and (iii) a toner image release layer formed over said fusing layer.

8. The fusing apparatus of claim 7, wherein said first elastomeric material comprises a thermally non-conductive first silicone rubber.

9. The fusing apparatus of claim 8, wherein said thermally non-conductive first silicone rubber comprises an unfilled low durometer silicone rubber.

10. The fusing apparatus of claim 9, wherein said unfilled low durometer first silicone rubber is relatively softer than said thermally conductive second silicone rubber.

11. The low load elastomeic fuser roller of claim 8, wherein said thermally non-conductive first silicone rubber comprises an unfilled low durometer silicone rubber.

12. The low load elastomeric fuser roller of claim 11, wherein said unfilled low durometer first silicone rubber is relatively softer than said thermally conductive second silicone rubber.

13. The fusing apparatus of claim 7, wherein said second elastomeric material comprises a thermally conductive second silicone rubber.

14. The fusing apparatus of claim 7, wherein said toner release layer comprises a layer of a flouroelastomer.

15. An electrostatographic reproduction machine for producing high quality toner images, the electrostatographic reproduction machine comprising:

(a) a moveable image bearing member including an image bearing surface;

(b) xerographic devices for forming toner images on said image bearing surface;

(c) means for transferring said toner images onto an image carrying substrate; and (d) a low load fusing apparatus including a pressure roller; an external heating device for heating a fusing surface; and a low load fuser roller mounted in heat receiving relationship with said external heating device and in fusing nip engagement with said pressure roller, said low load fuser roller having a first elastomeric material forming a generally cylindrical core for forming a relatively large fusing nip; a second elastomeric layer forming a fusing layer having a thickness of from about 0.3 to about 7.0 mm over said cylindrical core, and a toner image release layer formed over said fusing layer.

* * * * *